US005653524A

United States Patent [19]

Gray

[11] Patent Number: 5,653,524

[45] Date of Patent: Aug. 5, 1997

[54] ILLUMINATED RING

[76] Inventor: Paul D. Gray, 2180 Hwy 13, Cunningham, Tenn. 37052

[21] Appl. No.: 640,481

[22] Filed: May 1, 1996

[51] Int. Cl.[6] ..... F21V 33/00

[52] U.S. Cl. ..... 362/104; 362/800; 362/806; 63/15

[58] Field of Search ..... 362/203, 204, 362/800, 806, 190, 200, 201, 253, 234; 63/15, 2

[56] References Cited

U.S. PATENT DOCUMENTS

| | | | |
|---|---|---|---|
| 3,392,276 | 7/1968 | Roman | 362/104 |
| 3,804,307 | 4/1974 | Johnston | 362/104 |
| 4,012,629 | 3/1977 | Simms | 362/104 |
| 4,093,973 | 6/1978 | Vaagenes | 362/104 |
| 4,101,955 | 7/1978 | DuNah | 362/104 |
| 4,912,608 | 3/1990 | Lee | 362/104 |
| 4,975,809 | 12/1990 | Ku | 362/104 |
| 5,093,764 | 3/1992 | Hasegawa et al. | 362/29 |
| 5,113,325 | 5/1992 | Eisenbraun | 362/103 |

FOREIGN PATENT DOCUMENTS

| | | | |
|---|---|---|---|
| 19968 | of 1904 | United Kingdom | 362/104 |

*Primary Examiner*—Thomas M. Sember

[57] ABSTRACT

An illuminated ring including a pair of light emitting diodes with an associated switch. Such switch allows the selective actuation of either diode. Also included is a cap with opaque indicia printed thereon for releasably coupling about the diodes in use.

2 Claims, 3 Drawing Sheets

ILLUMINATED RING

BACKGROUND OF THE INVENTION

1. Field of the Invention

The present invention relates to an illuminated ring and more particularly pertains to illuminating indicia printed thereon.

2. Description of the Prior Art

The use of illuminated jewelry is known in the prior art. More specifically, illuminated jewelry heretofore devised and utilized for ornamental purposes are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,093,973 to Vaagenes; U.S. Pat. No. 5,253,149 to Ostema et al.; U.S. Pat. No. Design 326,066 to Sprague; U.S. Pat. No. 5,018,053 to Belknap et al.; U.S. Pat. No. 4,930,052 to Beige; and U.S. Pat. No. 4,296,459 to DeLuca.

In this respect, the illuminated ring according to the present invention substantially departs from the conventional concepts and designs of the prior art, and in so doing provides an apparatus primarily developed for the purpose of illuminating indicia printed on a ring.

Therefore, it can be appreciated that there exists a continuing need for a new and improved illuminated ring which can be used for illuminating indicia printed on a ring. In this regard, the present invention substantially fulfills this need.

SUMMARY OF THE INVENTION

In view of the foregoing disadvantages inherent in the known types of illuminated jewelry now present in the prior art, the present invention provides an improved illuminated ring. As such, the general purpose of the present invention, which will be described subsequently in greater detail, is to provide a new and improved illuminated ring which has all the advantages of the prior art and none of the disadvantages.

To attain this, the present invention essentially comprises an annular ring having a lower portion with a constant thin cross-section and an upper portion which bevels outwardly thus defining a circular top face. Also included is a base with a disk-shaped configuration having a top face, a bottom face, and a periphery formed therebetween. The bottom face is formed integrally with the top face of the ring in a horizontal orientation. The base has a small rectangular cut out formed on the top surface thereof adjacent to the periphery thereof. For containment of a power source, a battery compartment is included with a hollow disk-shaped configuration. The battery compartment has a top face, a bottom face coupled to the top face of the base, and a periphery formed therebetween thus defining an interior space. Access is afforded to the interior space via a rectangular aperture formed on the periphery of the battery compartment. The battery compartment further includes an annular detent formed about a lower extent of the periphery thereof adjacent to the base. A light housing is coupled to the top surface of the battery compartment. The light housing basically includes a generally dome-shaped shell constructed from a transparent material. Also included is a cap with a generally disk-shaped configuration. The cap has a top face with opaque indicia printed thereon. A periphery is integrally coupled to the top face and depends downwardly therefrom. An inwardly extending flange is formed on a terminating edge of the periphery for releasably coupling with the detent of the battery housing. The cap is constructed of a resilient translucent material. Finally, as best shown in FIG. 6, light circuitry includes a first light emitting diode and a second light emitting diode both of which are coupled within an interior space of the light housing. Each diode is adapted to emit different colors upon the actuation thereof. A current limiting resistor is coupled to the cathodes of both diodes at a first terminal thereof. A pair of battery contacts are included with a first contact situated on the top surface of the battery compartment and electrically connected to a second terminal of the resistor. Further included is a second contact situated on the bottom surface of the battery compartment. Together the contacts allow a battery to be removably situated therebetween for powering purposes. A small triple throw triple pole switch is situated on the upper portion of the ring. The switch has a first terminal connected to the second battery contact, a second terminal connected to the anode of the first diode, and a third terminal connected to the anode of the second diode. As such, the first diode may be actuated in a first mode of operation wherein the first terminal of the switch is connected to the second terminal thereof. Also, the second diode may be actuated in a second mode of operation wherein the first terminal of the switch is connected to the third terminal thereof. Lastly, neither of the diodes may be actuated in a third mode of operation wherein the first terminal of the switch is open.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and technology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated ring which has all the advantages of the prior art illuminated jewelry and none of the disadvantages.

It is another object of the present invention to provide a new and improved illuminated ring which may be easily and efficiently manufactured and marketed.

It is a further object of the present invention to provide a new and improved illuminated ring which is of a durable and reliable construction.

An even further object of the present invention is to provide a new and improved illuminated ring which is susceptible of a low cost of manufacture with regard to both materials and labor, and which accordingly is then susceptible of low prices of sale to the consuming public, thereby making such illuminated ring economically available to the buying public.

Still yet another object of the present invention is to provide a new and improved illuminated ring which provides in the apparatuses and methods of the prior art some of the advantages thereof, while simultaneously overcoming some of the disadvantages normally associated therewith.

Still another object of the present invention is to illuminate indicia printed on a ring.

Lastly, it is an object of the present invention to provide a new and improved illuminated ring including a pair of light emitting diodes with an associated switch. Such switch allows the selective actuation of either diode. Also included is a cap with opaque indicia printed thereon for releasably coupling about the diodes in use.

These together with other objects of the invention, along with the various features of novelty which characterize the invention, are pointed out with particularity in the claims annexed to and forming apart of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
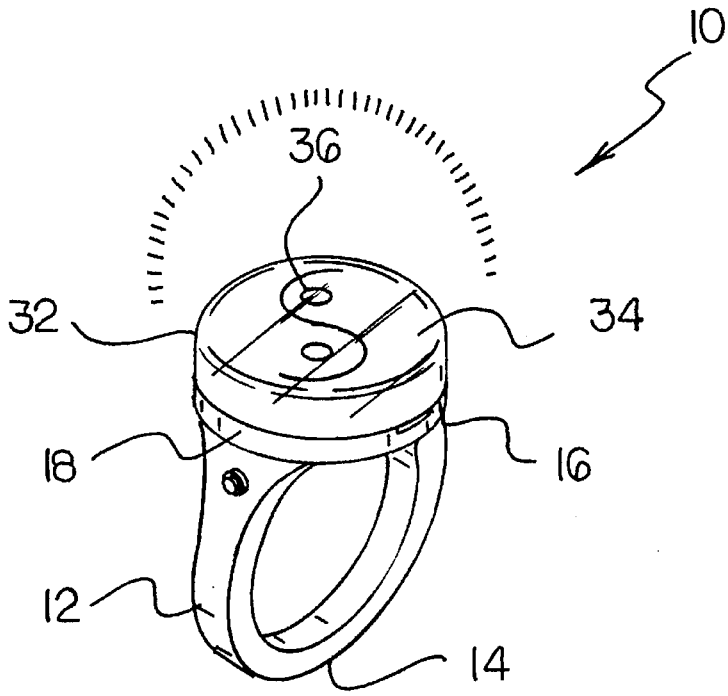
FIG. 1 is a perspective illustration of the preferred embodiment of the illuminated ring constructed in accordance with the principles of the present invention.
Figure 2:
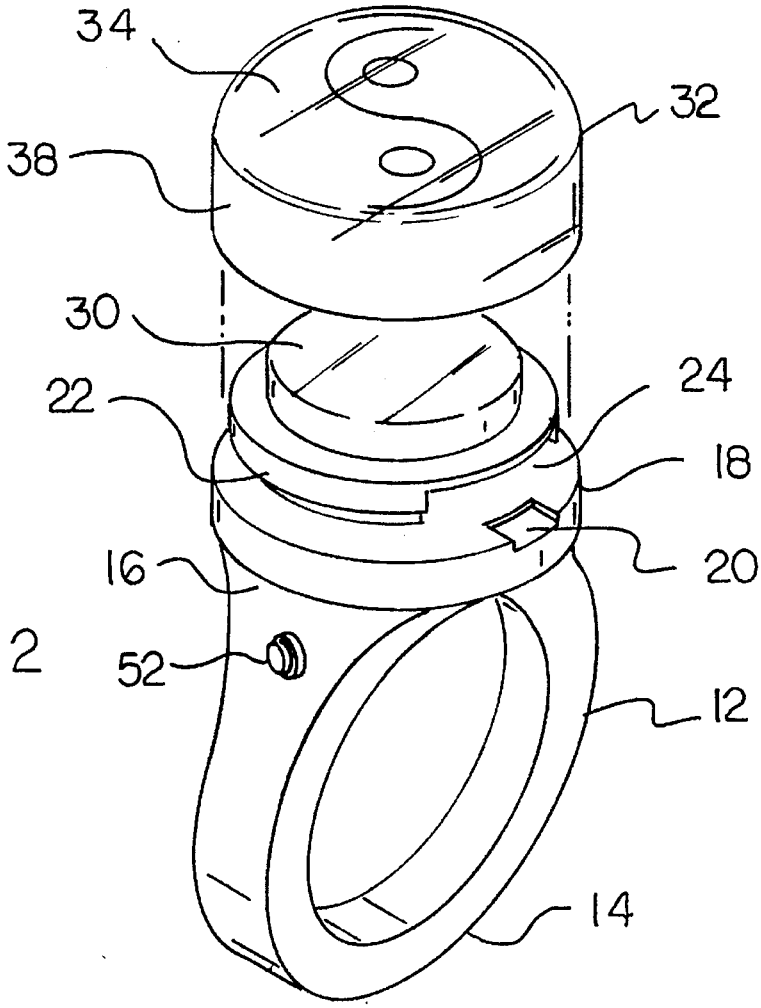
FIG. 2 is a perspective view of the present invention with the cap thereof removed.
Figure 3:
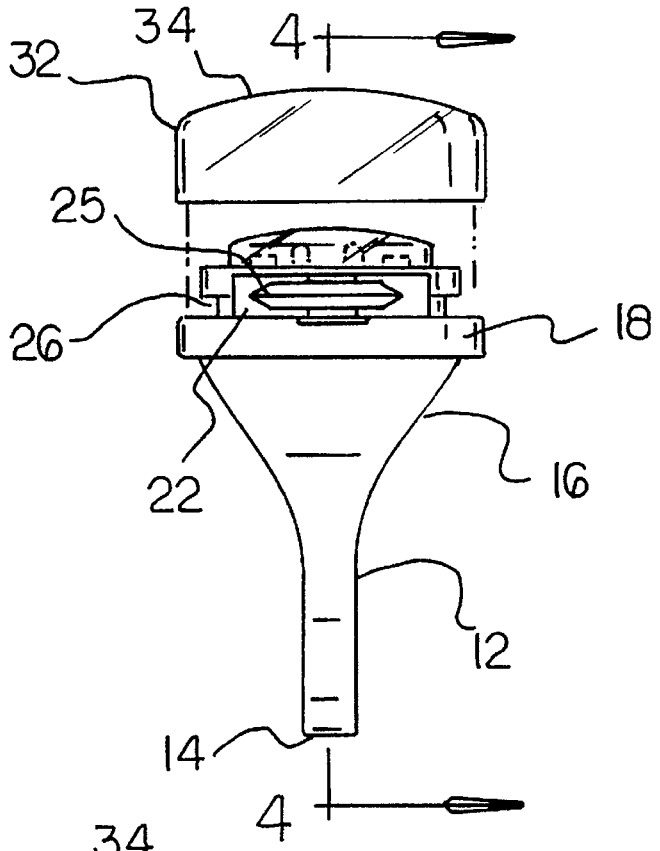
FIG. 3 is a side plan view of the present invention.
Figure 4:
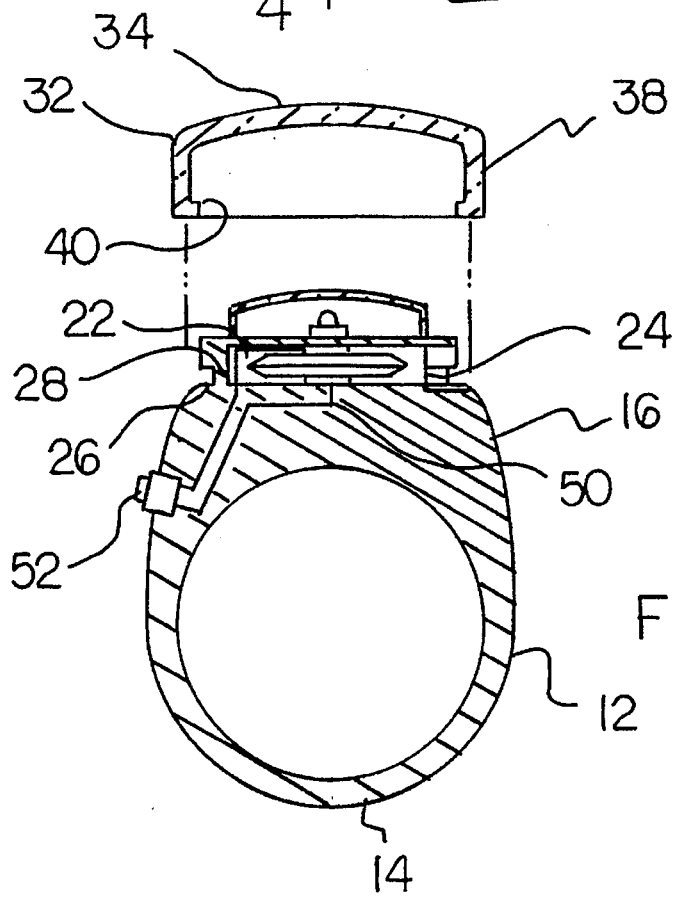
FIG. 4 is a cross-sectional view taken along line 4—4 shown in FIG. 3.

With reference now to the drawings, and in particular to FIG. 1 thereof, a new and improved illuminated ring embodying the principles and concepts of the present invention and generally designated by the reference numeral 10 will be described.

The present invention, the new and improved illuminated ring, is comprised of a plurality of components. Such components in their broadest context include a ring, base, battery compartment, light housing, cap, and light circuitry. Such components are individually configured and correlated with respect to each other so as to attain the desired objective.

More specifically, it will be noted that the system 10 of the present invention includes an annular ring 12 having a lower portion 14 with a constant thin cross-section and an upper portion 16 which bevels outwardly thus defining a circular top face. The ring may be constructed from either a metal or rigid plastic.

Also included is a base 18 with a disk-shaped configuration having a top face, a bottom face, and a periphery formed therebetween. The bottom face is formed integrally with the top face of the ring in a horizontal orientation. The base has a small rectangular cut out 20 formed on the top surface thereof adjacent to the periphery thereof.

For containment of a power source, a battery compartment 22 is included with a hollow disk-shaped configuration. Preferably, the diameter of the battery compartment is less than that of the base. The battery compartment has a top face, a bottom face coupled to the top face of the base, and a periphery formed therebetween thus defining an interior space. Access is afforded to the interior space via a rectangular aperture 24 formed in the periphery of the battery compartment. Such aperture is radially aligned with the cut out and is sized to allow a small 3-volt watch battery 25 access therein. The battery compartment further includes an annular detent 26 formed about a lower extent of the periphery thereof flush with the base. As an option, a hole 28 may be formed in the periphery of the battery compartment opposite the access aperture for allowing the ejection of a battery using a small rod such as a paper clip.

A light housing 30 is coupled to the top surface of the battery compartment. The light housing basically includes a generally dome-shaped shell constructed from a rigid transparent material.

Also included is a cap 32 with a generally disk-shaped configuration. The cap has a top face 34 with opaque indicia 36 printed thereon. Such indicia may take the form of a logo, name, or picture. A periphery 38 is integrally coupled to the top face and depends downwardly therefrom. An inwardly extending flange 40 is formed on a terminating edge of the periphery for releasably coupling with the detent of the battery housing. The cap is constructed of a resilient translucent material. Ideally, the thickness of the cap is equivalent to the difference between the diameter of the base and the battery compartment. When the cap is secured about the battery compartment and light housing, the terminating edge of the periphery remains flush with the periphery of the base. Also, in order to remove the cap, a user may utilize the cut out of the base.

Figure 6:
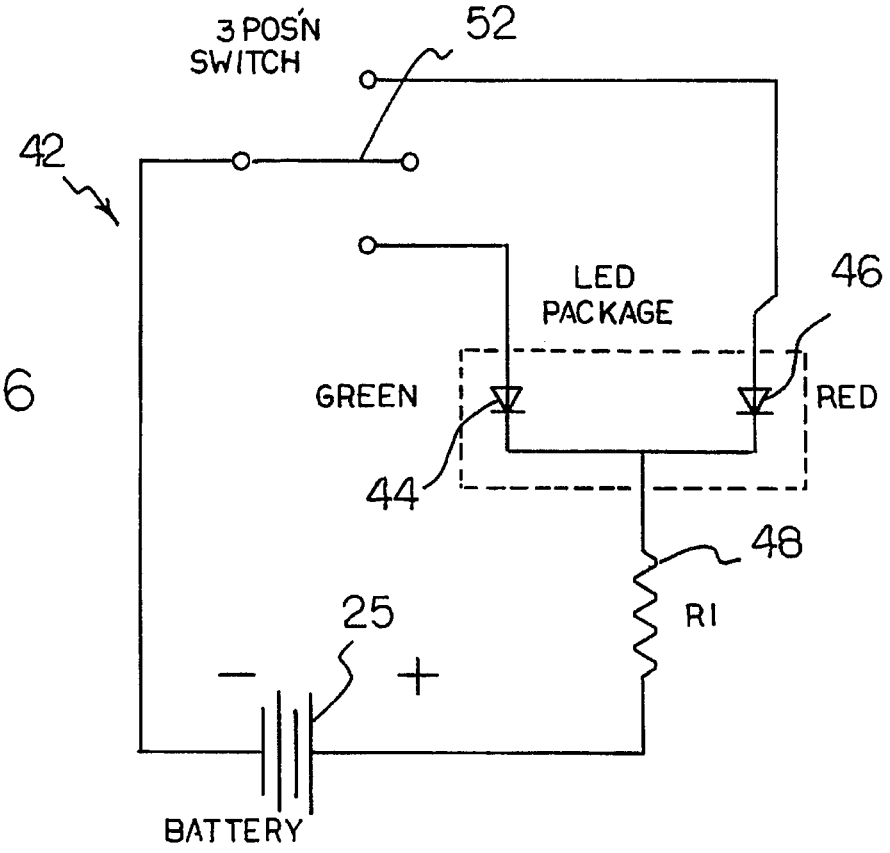
FIG. 6 is a schematic depicting the interconnection of electrical components employed in the present invention.

Finally, as best shown in FIG. 6, light circuitry 42 includes a first light emitting diode 44 and a second light emitting diode 46 both of which are coupled within an interior space of the light housing. Each diode is adapted to emit different colors upon the actuation thereof. Ideally, a single-package MOUSER 592-SLM R/G 20 mA , 2–2.8 V LED is employed in the present invention. A current limiting resistor 48 is coupled to the cathodes of both diodes at a first terminal thereof. A pair of battery contacts 50 are included with a first contact situated on the top surface of the battery compartment and electrically connected to a second terminal of the resistor. Further included is a second contact situated on the bottom surface of the battery compartment. Together the contacts allow a battery to be removably situated therebetween for powering purposes. A small triple throw triple pole switch 52 is situated on the exterior surface of the upper portion of the ring. The switch has a first terminal connected to the second battery contact, a second terminal connected to the anode of the first diode, and a third terminal connected to the anode of the second diode. As such, the first diode may be actuated in a first mode of operation wherein the first terminal of the switch is connected to the second terminal thereof. Also, the second diode may be actuated in a second mode of operation wherein the first terminal of the switch is connected to the third terminal thereof. Lastly, neither of the diodes may be actuated in a third mode of operation wherein the first terminal of the switch is open. The user may transfer from mode to mode merely by continuously depressing the switch.

Figure 5:
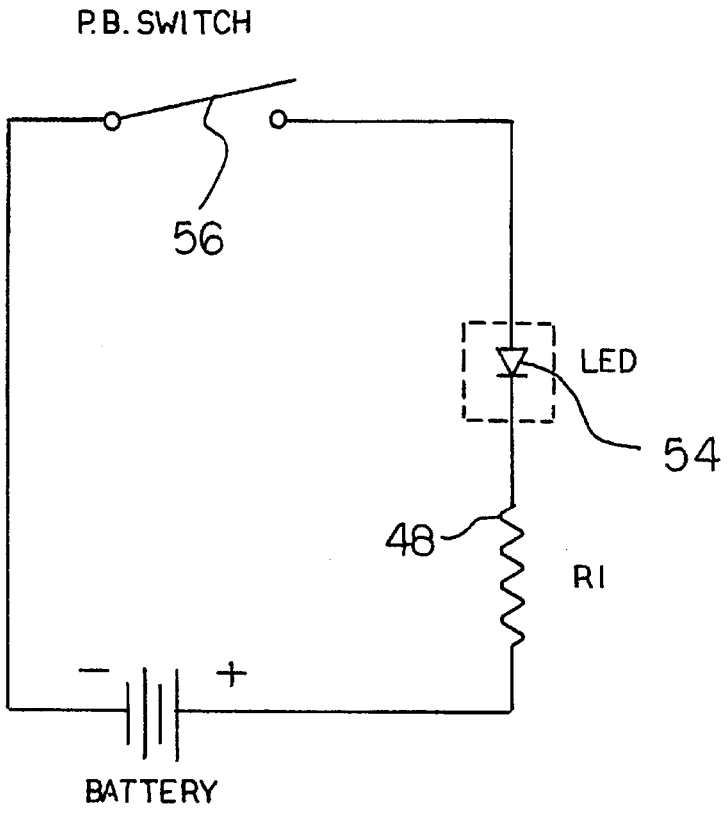
FIG. 5 is a schematic depicting the interconnection of electrical components employed in an alternate embodiment of the present invention.

In an alternate embodiment, as shown in FIG. 5, a single diode 54 with an associated single throw switch 56 may be employed. Such may be done due to economical motivations or to provide a brighter light.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved illuminated ring comprising, in combination:

an annular ring having a lower portion with a constant thin cross-section and an upper portion which bevels outwardly thus defining a circular top face;

a base with a disk-shaped configuration having a top face, a bottom face, and a periphery formed therebetween wherein the bottom face is formed integrally with the upper portion of the ring in a horizontal orientation, the base having a small rectangular cut out formed on the top surface adjacent to the periphery thereof;

a battery compartment with a hollow disk-shaped configuration having a top face, a bottom face coupled to the top face of the base, and a periphery formed therebetween thus defining an interior space with access afforded thereto via a rectangular aperture formed thereon, the battery compartment further including an annular detent formed about a lower extent of the periphery thereof adjacent to the base;

a light housing coupled to the top surface of the battery compartment, the light housing including a generally dome-shaped shell constructed from a transparent material;

a cap with a generally disk-shaped configuration having a top face with opaque indicia printed thereon, a periphery integrally coupled to the top face of the cap and depending therefrom, and an inwardly extending flange formed on a terminating edge of the periphery for releasably coupling with the detent of the battery housing, wherein the cap is constructed of a resilient translucent material; and light circuitry including a first light emitting diode and a second light emitting diode coupled with an interior space of the light housing with each diode adapted to emit different colors upon actuation thereof, a current limiting resistor coupled to cathodes of both diodes at a first terminal thereof, a pair of battery contacts including a first contact situated on the top surface of the battery compartment and electrically connected to a second terminal of the resistor and a second contact situated on the bottom surface of the battery compartment for allowing a battery to be removably situated therebetween for powering purposes, a small triple throw triple pole switch situated on the upper portion of the ring having a first terminal connected to the second battery contact, a second terminal connected to an anode of the first diode, and a third terminal connected to an anode of the second diode, whereby the first diode may be actuated in a first mode of operation wherein the first terminal of the switch is connected to the second terminal thereof, the second diode may be actuated in a second mode of operation wherein the first terminal of the switch is connected to the third terminal thereof, and neither of the diodes may be actuated in a third mode of operation wherein the first terminal of the switch is open.

2. An illuminated ring comprising:

an annular ring:

illumination means coupled to the annular ring and adapted to emit light upon actuation thereof, the illumination means including a first light emitting diode and a second light emitting diode adapted to emit different colors upon actuation thereof, a current limiting resistor coupled to cathodes of both diodes at a first terminal thereof, a pair of battery contacts including a first contact electrically connected to a second terminal of the resistor and a second contact for allowing a battery to be removably situated therebetween for powering purposes, a small triple throw triple pole switch situated on the upper portion of the ring having a first terminal connected to the second battery contact, a second terminal connected to an anode of the first diode, and a third terminal connected to an anode of the second diode, whereby the first diode may be actuated in a first mode of operation wherein the first terminal of the switch is connected to the second terminal thereof, the second diode may be actuated in a second mode of operation wherein the first terminal of the switch is connected to the third terminal thereof, and neither of the diodes may be actuated in a third mode of operation wherein the first terminal of the switch is open; and a cap with opaque indicia printed thereon for releasably coupling about the illumination means.

* * * * *